US010751566B2

(12) United States Patent
Beddoe

(10) Patent No.: US 10,751,566 B2
(45) Date of Patent: Aug. 25, 2020

(54) PHYSICAL THERAPY DEVICE FOR PELVIC REALIGNMENT AND REDUCING LOWER BACK PAIN

(71) Applicant: Christopher Eugene Beddoe, Capistrano Beach, CA (US)

(72) Inventor: Christopher Eugene Beddoe, Capistrano Beach, CA (US)

( * ) Notice: Subject to any disclaimer, the term of this patent is extended or adjusted under 35 U.S.C. 154(b) by 91 days.

(21) Appl. No.: 15/916,426

(22) Filed: Mar. 9, 2018

(65) Prior Publication Data

US 2019/0275369 A1 Sep. 12, 2019

(51) Int. Cl.
*A63B 23/04* (2006.01)
*A63B 21/002* (2006.01)

(52) U.S. Cl.
CPC ..... *A63B 23/0482* (2013.01); *A63B 21/0023* (2013.01); *A61H 2201/164* (2013.01); *A61H 2203/0443* (2013.01)

(58) Field of Classification Search
None
See application file for complete search history.

(56) References Cited

U.S. PATENT DOCUMENTS 3,750,659 A * 8/1973 Loomans ..... A61F 5/0104 602/23
4,288,073 A * 9/1981 Petrachonis ..... A63B 21/0724 482/106
4,466,610 A 8/1984 Israel
D292,427 S * 10/1987 Baburek ..... D21/692
4,770,414 A * 9/1988 Fredrickson ..... A63B 23/0211 482/148
4,861,020 A * 8/1989 Soligny, Sr. ..... A63B 21/1627 482/40
4,863,158 A * 9/1989 Tassone ..... A63B 21/0004 482/140
4,863,159 A * 9/1989 Brown, Jr. ..... A63B 21/0004 482/126
4,872,667 A * 10/1989 Favot ..... A63B 21/0724 482/106
5,022,648 A * 6/1991 Travis ..... A63B 21/00043 482/122
5,038,758 A 8/1991 Iams et al.
5,098,361 A * 3/1992 Danylieko ..... A63B 21/0615 482/106
5,232,425 A * 8/1993 Miller ..... A63B 21/0004 482/121
5,269,737 A * 12/1993 Sobotka ..... A63B 21/0552 482/123
5,399,138 A * 3/1995 Jones ..... A63B 21/0004 482/122

(Continued)

*Primary Examiner* — Garrett K Atkinson
(74) *Attorney, Agent, or Firm* — The Concept Law Group, PA; Scott M. Garrett; Scott D. Smiley

(57) ABSTRACT

A tool for correcting pelvic misalignment includes a generally elongated body with handles at each end, and leg rest portions formed between the handles. The leg rest portions are configured to receive a user's legs at the upper leg/thigh, and to allow the user to isometrically urge their legs in opposite directions, forward and backward, while grasping the handles to hold the tool in place, statically. As a result, a force result on the user's pelvis, creating a rotation that can re-align the user's pelvis with their lumbar spine, and reduce lower back pain.

20 Claims, 10 Drawing Sheets

(56) References Cited

U.S. PATENT DOCUMENTS 5,417,628 A * 5/1995 Vanderbleek ..... A63B 21/1636 482/40
D368,562 S * 4/1996 Sterling ..... D32/59
5,695,436 A * 12/1997 Huang ..... A63B 21/0004 482/121
5,820,520 A * 10/1998 Sieber ..... A63B 23/0227 482/34
6,022,302 A * 2/2000 McBride ..... A63B 21/00043 482/121
6,048,294 A * 4/2000 Formanek ..... A63B 21/00047 482/141
6,179,748 B1 * 1/2001 Barr ..... A63B 1/00 482/38
6,193,637 B1 * 2/2001 Corbin ..... A63B 21/012 446/120
6,203,473 B1 3/2001 Atwood
6,296,595 B1 10/2001 Stark et al.
6,595,904 B1 7/2003 Staffa
6,860,841 B1 * 3/2005 Mortorano ..... A63B 21/0004 482/126
6,939,277 B2 * 9/2005 Tuller ..... A63B 21/026 482/126
6,971,392 B2 12/2005 Lindahn et al.
7,022,054 B2 * 4/2006 Contreras ..... A61H 1/0244 482/131
7,112,166 B2 * 9/2006 Brown, Jr. ..... A63B 21/026 482/140
7,128,699 B2 * 10/2006 Hsu ..... A63B 21/0004 482/125
7,429,236 B2 * 9/2008 Dalebout ..... A63B 21/00072 482/121
7,569,003 B1 * 8/2009 Huffman ..... A63B 21/00043 482/111
7,591,772 B2 * 9/2009 Shillington ..... A63B 21/0728 482/106
7,604,580 B2 10/2009 Lamarque
7,625,323 B1 * 12/2009 Lin ..... A63B 21/015 482/112
7,662,067 B2 * 2/2010 Payne ..... A63B 21/00047 482/140
7,854,695 B2 * 12/2010 Lightbourne ..... A61H 1/0292 482/142
8,062,184 B2 * 11/2011 Brandenburg ..... A63B 21/0724 482/45
8,172,726 B1 * 5/2012 Leier ..... A63B 1/00 482/23
8,224,464 B2 * 7/2012 Wise ..... A61H 21/00 600/38
8,888,665 B2 * 11/2014 Pfitzer ..... A63B 21/0602 482/104
8,905,952 B2 * 12/2014 Berthiaume ..... A61H 1/0218 601/134
9,079,085 B2 * 7/2015 McBride ..... A63B 69/0048
9,114,273 B2 * 8/2015 Kehoe ..... A63B 21/00047
9,192,804 B2 * 11/2015 Inglut ..... A63B 21/068
9,220,339 B1 * 12/2015 Chen ..... A63B 47/00
9,226,844 B2 1/2016 Lockett
9,278,253 B2 * 3/2016 Ho ..... A63B 21/00185
9,452,308 B2 * 9/2016 Lentz ..... A63B 1/00
9,573,018 B2 * 2/2017 MacColl ..... A63B 23/0211
9,622,938 B2 * 4/2017 Wise ..... A61N 1/0512
9,694,233 B2 * 7/2017 Chou ..... A63B 21/0783
9,833,654 B1 * 12/2017 Gant ..... A63B 21/0724
2004/0029689 A1 * 2/2004 Contreras ..... A61H 1/0244 482/148
2004/0033867 A1 * 2/2004 Katami ..... A63B 23/03575 482/109
2004/0082449 A1 * 4/2004 Brown, Jr. ..... A63B 21/026 482/140
2005/0143230 A1 * 6/2005 Dalebout ..... A63B 21/00072 482/121
2006/0189459 A1 * 8/2006 Hsu ..... A63B 21/0004 482/125
2006/0217246 A1 * 9/2006 Payne ..... A63B 21/00047 482/96
2007/0243977 A1 * 10/2007 Zeien ..... A63B 21/4035 482/106
2008/0122278 A1 * 5/2008 Lightbourne ..... A61H 1/0292 297/314
2008/0200316 A1 * 8/2008 Shillington ..... A63B 21/0728 482/106
2009/0210027 A1 * 8/2009 Wise ..... A61H 21/00 607/46
2009/0278317 A1 * 11/2009 Lima ..... A63B 65/00 273/343
2010/0323852 A1 * 12/2010 Locsin ..... A63B 1/00 482/96
2010/0323854 A1 * 12/2010 Brandenburg ..... A63B 21/0724 482/106
2011/0269607 A1 * 11/2011 Choi ..... A63B 21/0004 482/126
2012/0094808 A1 * 4/2012 Leier ..... A63B 1/00 482/40
2013/0045844 A1 * 2/2013 Huang ..... A63B 21/0004 482/140
2013/0072364 A1 * 3/2013 Chen ..... A63B 23/1236 482/141
2013/0116093 A1 * 5/2013 Kehoe ..... A63B 21/00047 482/40
2013/0150221 A1 * 6/2013 Sibley ..... A63B 21/15 482/148
2013/0178338 A1 * 7/2013 Ross ..... A63B 1/00 482/40
2013/0196830 A1 * 8/2013 Pfitzer ..... A63B 21/0602 482/110
2014/0088469 A1 * 3/2014 Wise ..... A61N 1/0512 601/46
2014/0135182 A1 * 5/2014 Inglut ..... A63B 21/068 482/96
2014/0221163 A1 * 8/2014 McBride ..... A63B 69/0048 482/40
2014/0371040 A1 * 12/2014 Vasquez ..... A63B 1/00 482/132
2015/0105792 A1 * 4/2015 Adams ..... A61B 17/42 606/119
2015/0119212 A1 * 4/2015 Rodriguez ..... A63B 21/4035 482/139
2015/0148197 A1 * 5/2015 Lentz ..... A63B 1/00 482/40
2015/0375037 A1 * 12/2015 Ho ..... A63B 21/00185 482/140
2016/0082313 A1 * 3/2016 MacColl ..... A63B 23/0211 482/140
2016/0213966 A1 * 7/2016 Chou ..... A63B 21/0783
2017/0156458 A1 * 6/2017 Hayden ..... A45B 9/04
2017/0157457 A1 * 6/2017 Kurabieski ..... A63B 21/4049
2018/0290011 A1 * 10/2018 Kelly ..... A63B 21/4035
2018/0296873 A1 * 10/2018 Amyan ..... A63B 21/0722
2019/0232140 A1 * 8/2019 Rohner ..... A63B 69/14

* cited by examiner

PHYSICAL THERAPY DEVICE FOR PELVIC REALIGNMENT AND REDUCING LOWER BACK PAIN

FIELD OF THE INVENTION

The present invention relates generally to physical therapy devices, and, more particularly, relates to a physical therapy device which isometrically engages the user's legs at the thigh level when the user urges the legs in opposite directions in order to impart rotational force on the user's lower extremities and pelvis and bring the user's pelvis and lumbar spine into proper alignment.

BACKGROUND OF THE INVENTION

Lower back pain is a chronic condition experienced by many people. A common cause of lower back pain is a misalignment of the pelvis with the lower lumbar spine. Misalignment can occur in a number of ways, such as injury due to twisting, standing on uneven surfaces, or sitting in uneven positions, to name a few common causes. A person who develops initial pain may then favor one side of their body over another, which can lead to a muscle imbalance, joint malalignment, further aggravating the problem.

Currently there are many products that address non-specific lower back pain using "traction force," which involves applying a force in an attempt to separate joint surfaces from one another. Many products that are currently available help to facilitate/cause separation in the lumbar and thoracic spine between vertebrae to elevate pressure on the intervertebral discs thus reducing lower back pain. One type of device that is used to generate traction force is a straight bar, like a broomstick, that the user, while lying on their back with their knees raised equally, lays across their thigs and pushes against their legs to exert force in the opposite direction. The disadvantage using a traction force device is that it is not a long term solution for remedying lower back pain. Scientific studies support that while a person is using traction it does alleviate pain and the effects may last for minutes to hours after performed. However it is far more common that when a person stops using a traction force device the pain relieving effect also stops. Typically, within minutes to hours, the pressure relieved while using a traction force device returns, along with pain. These devices do not realign, stabilize, or strengthen the pelvis, lower back, and associated muscle groups, which is what is required for lasting relief and rehabilitation.

Therefore, a need exists to overcome the problems with the prior art as discussed above.

SUMMARY OF THE INVENTION

The invention provides a physical therapy device for pelvic realignment and reducing lower back pain that overcomes the hereinafore-mentioned disadvantages of the heretofore-known devices and methods of this general type and that further strengthens supporting muscle groups to help prevent further back pain.

With the foregoing and other objects in view, there is provided, in accordance with the invention, a physical therapy device for relieving forms of lower back pain, which includes a longitudinal body defining an axis and having first and second ends on the axis. The longitudinal body further has a midpoint on the axis. The physical therapy device can further include a first handle formed at the first end along the axis, the handle having a distal end and a proximal end, and a second handle formed at the second end along the axis, likewise having a distal end and a proximal end. The physical therapy device can further include a first leg rest formed by the longitudinal body deviating from the axis between the proximal end of the first handle and the midpoint, and a second leg rest formed by the longitudinal body deviating from the axis between the proximal end of the second handle and the midpoint in a direction opposite that of the first leg rest with respect to the axis.

In accordance with another feature, an embodiment of the present invention includes a first pad disposed on the first leg rest and a second pad disposed on the second leg rest.

In accordance with a further feature of the present invention, the first and second leg rests can each comprise an apex having a radius facing the axis.

In accordance with a further feature of the present invention, the apex of each of the first and second leg rests around their respective radiuses are wider, in a direction perpendicular to a plane defined by the longitudinal body, than portions of the longitudinal body on either sides of the apexes.

In accordance with a further feature of the present invention, a distance between the apex of the first leg rest and the apex of the second leg rest, as measured along the axis, is between 10 and 13 inches.

In accordance with a further feature of the present invention, the first leg rest and second leg rest are joined by a transverse member that crosses the axis at angle between 45 degrees and 90 degrees with respect to the axis.

In accordance with a further feature of the present invention, the first leg rest and second leg rest and joined by respective transverse portions that couple together at a midpoint of the device, between the first and second leg rests.

In accordance with a further feature of the present invention, the longitudinal body is tubular.

In accordance with a further feature of the present invention, a displacement distance is defined between the axis and the first leg rest and between the axis and the second leg rest, wherein the displacement distance is between three and six inches.

In accordance with other embodiments of the invention, there is provided a pelvic alignment tool having first and second ends which define an axis between the first and second ends, the pelvic alignment tool includes a first handle formed at the first end along the axis, having a distal end and a proximal end, and a second handle formed at the second end along the axis, also having a distal end and a proximal end. The pelvic alignment tool can further include a first leg rest formed between the proximal end of the first handle and a midpoint of the pelvic alignment tool, which is configured to receive a first thigh of a user such that the axis between the first and second ends passes through the first thigh. The pelvis alignment tool can further include a second leg rest formed between the proximal end of the second handle and the midpoint of the pelvic alignment tool that is likewise configured to receive a second thigh of a user such that the axis between the first and second ends passes through the second thigh. The first and second leg rests are further configured to isometrically engage the first and second thighs when the user urges the first and second thighs in opposite directions, perpendicular to the axis, between the first and second ends, while holding the first and second handles substantially stationary.

In accordance with other embodiments of the invention, there is provided a device for isometrically exercising a user's hip extensors and hip flexors to adjust pelvic alignment, which include first and second handles oriented along a common axis at opposite ends of a body of the device. The device further includes a first leg rest member formed between the first and second handles, and a second leg rest member formed between the first and second handles opposite the first leg member with respect to the common axis.

Although the invention is illustrated and described herein as embodied in a physical therapy device for pelvic realignment and reducing lower back pain, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the an axis along the body of a physical therapy device, from one end to the other. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
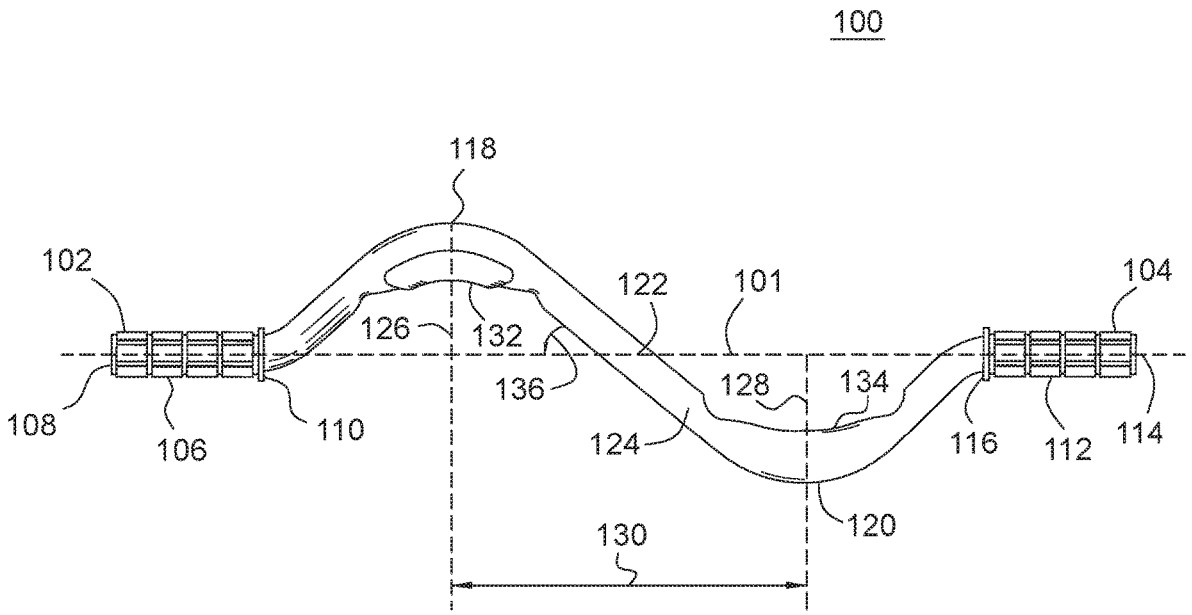
FIG. 1 is a top plan view of a physical therapy device for relieving forms of lower back pain, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient physical therapy device for relieving lower back pain. Embodiments of the invention provide a physical therapy device for relieving forms of lower back pain that includes a longitudinal body defining an axis and having first and second opposing ends. The longitudinal body further has a midpoint on the axis. The device further includes a first handle portion formed at the first end along the axis and having a distal end and a proximal end, and a second handle portion formed at the second end along the axis and having a distal end and a proximal end. The device can further include a first leg rest formed by the body deviating from the axis between the proximal end of the first handle and the midpoint, and a second leg rest formed by the body deviating from the axis between the proximal end of the second handle and the midpoint in a direction opposite that of the first leg rest with respect to the axis.

In addition, embodiments of the invention provide a pelvic alignment tool that has first and second ends defining an axis between the first and second ends, and can further include a first handle portion formed at the first end along the axis and having a distal end and a proximal end, and a second handle portion formed at the second end along the axis and having a distal end and a proximal end. The device can further include a first leg rest formed between the proximal end of the first handle and a midpoint of the pelvic alignment tool that is configured to receive a first thigh of a user such that the axis between the first and second ends passes through the first thigh. Likewise the device can further include a second leg rest formed between the proximal end of the second handle and the midpoint of the pelvic alignment tool that is configured to receive a second thigh of a user such that the axis between the first and second ends passes through the second thigh. The first and second leg rests can be further configured to isometrically engage the first and second thighs when the user urges the first and second thighs in opposite directions perpendicular to the axis between the first and second ends while holding the first and second handles substantially stationary.

In addition, embodiments of the claimed invention can include a device for isometrically exercising a user's hip extensors and hip flexors to adjust pelvic alignment that includes first and second handles oriented along a common axis at opposite ends of a body of the device. The device can further include a first leg rest member formed between the first and second handles, and a second leg rest member formed between the first and second handles opposite the first leg member with respect to the common axis.

Referring now to FIG. 1, there is shown therein a top plan view of a physical therapy device 100 for relieving forms of lower back pain, in accordance with some embodiments. The device 100 is configured to be placed in engagement with a patient's legs, at about the mid-thigh level, while the patient lays on their back horizontally, or with their upper body slightly elevated. The device comprises a body that is generally elongated along an axis 101. The device has opposing ends 102, 104 at either side of the device 100 along the axis 101. A first handle 106 is provided at one end 102, and a second handle 112 is provided at the other end 104. The handles 106, 112 can be slid over the ends 102, 104, and can be, for example, similar to hand grips used on some bicycle handlebars. In some embodiments the handles 106, 112 can simply be the bare portion of the body of the device 100 at the ends 102, 104. The handles 104, 106 are oriented along, and in line with, the axis 101. The first handle 106 has a distal end 108 and a proximal end 110, and the second handle 112 likewise has a distal end 114 and a proximal end 116. As used here, the terms "distal" and "proximal" mean father and closer, respectively, to the center or midpoint 122 of the device 100. The body of the device 100 also provides a first leg rest 118 and a second leg rest 120. The leg rests or leg rest portions 118, 120 are formed by the body of the device 100 deviating away from the axis 101 between the proximal ends 10, 116 of the handles 106, 112, respectively, and the midpoint 122 of the device. As embodied in FIG. 1, the leg rests 118, 120 have generally arcuate apexes having a peak at lines 126, 128, respectively. The displacement distance from the axis 101 to each apex of the leg rests 118, 120 is on the order of three to six inches. The distance 130 between apexes, or the center of the leg rests 118, 120, can be between about ten to eleven inches. As shown, the second leg rest 120 is displaced in the opposite direction, relative to the axis 101 to that of the first leg rest 118. The first leg rest 118 can include a pad 132, and the second leg rest likewise can include a pad 134 on the inner sides of the leg rests 118, 120, where the patient's legs will contact the leg rests 118, 120. Further, a middle portion 124 of the body joins the first and second leg rests 118, 120, traversing the axis 101 at the midpoint 122, at an angle 136 of between about 30 to 90 degrees with respect to the axis 101.

Figure 2:
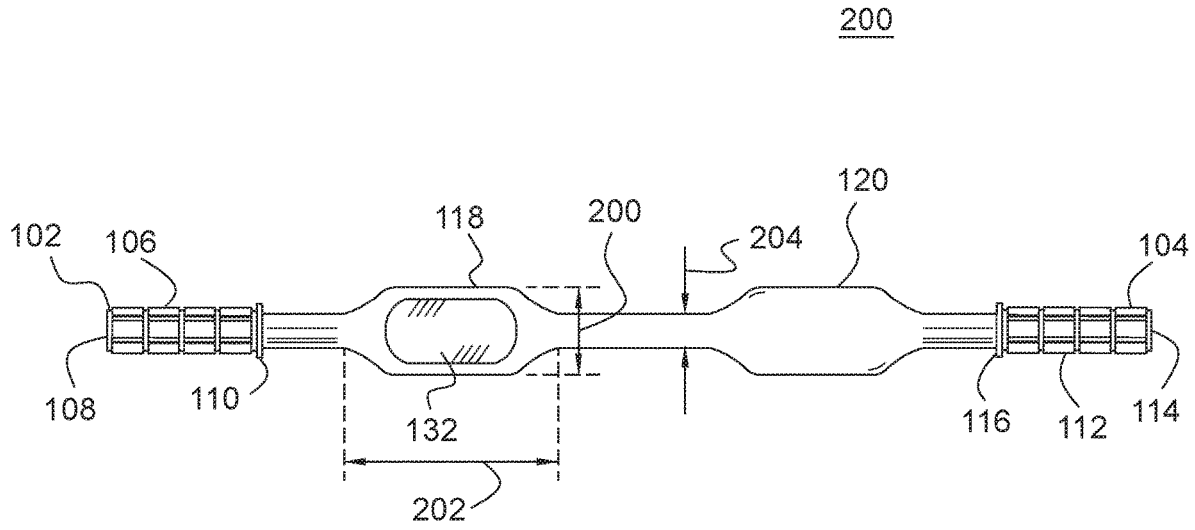
FIG. 2 is a side elevational view of the physical therapy device of FIG. 1.

FIG. 2 is a side elevational view of the physical therapy device 100, shown in FIG. 1. From this view it can be seen that the first leg rest 118 and second leg rest 120 are wider than the generally tubular portions of the rest of the body of the device 100. The leg rests 118, 120 can have a width 200 of about two to four inches, and a span 202 of about four to six inches. The remainder of the body portions of the device can have a diameter 204 of about three quarters to one and one quarter inches. Furthermore, from end 108 to end 114 the device can have a total length of about twenty eight to thirty two inches. One skilled in the art, however, will recognize that various dimensions, including those outside of the ranges given here, can be used to create devices to accommodate different body sizes. For example, a child would use a device of a different size than one for an adult. In general, the device 100 should be dimensioned such that the handles 102, 104 extend to the outside of the user's legs where the user can grasp the handles while lying as described, and the user's leg rest inside the leg rest portions such that the user's thigh/upper legs are substantially parallel.

Figure 3:
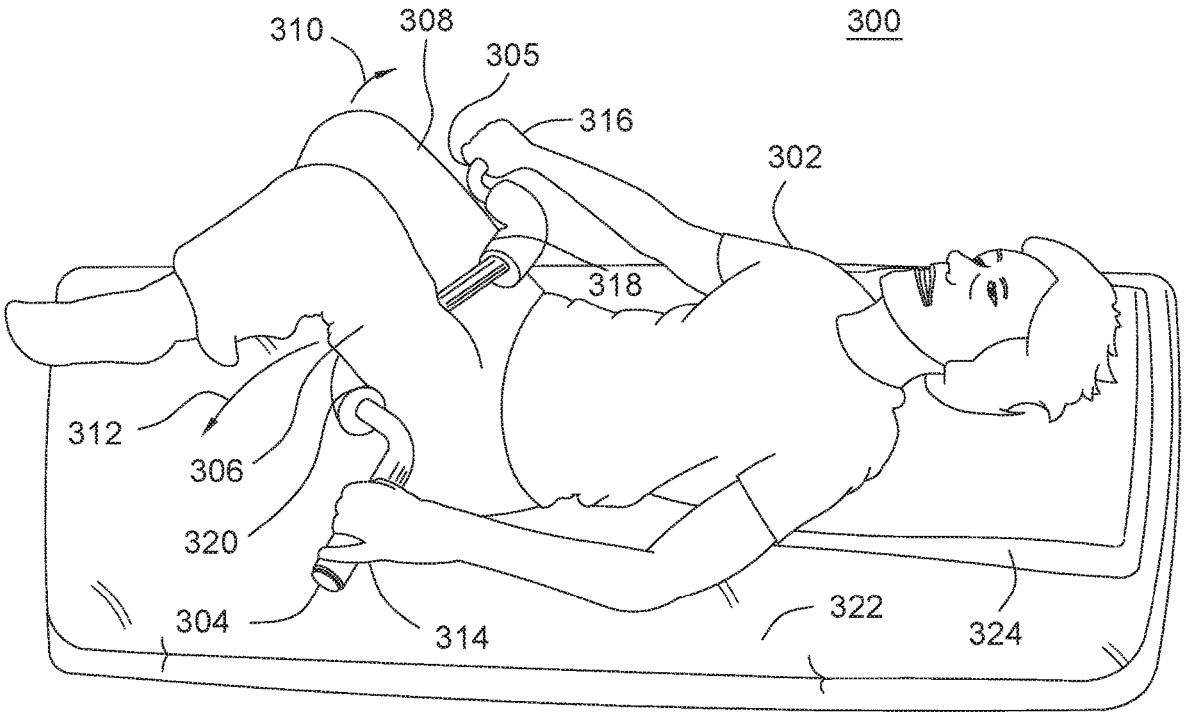
FIG. 3 is a perspective view of a patient using a physical therapy device, in accordance with some embodiments.

FIG. 3 is a perspective view 300 of a patient 302 using a physical therapy device, in accordance with some embodiments. In use, the patient 302 or user lies on their back on horizontal surface 322, preferably with their upper body and head flat on the surface. The user can also lie in a secondary position, with the upper body and head slightly elevated (e.g. such that there is about a 15 degree angle from their head to their hips, with respect to the horizontal surface) on a pillow 324 or equivalent. The user 302 places the device in engagement with their legs such that, for example, the back of the user's left thigh 306 engages the pad 320 of the first leg rest (e.g. 118), and the front of the user's right thigh 308 engages the pad 318 of the second leg rest (e.g. 120). While holding the first and second handles 304, 305 with their left and right hands 314, 316, respectively, the user 302 simultaneously urges, through muscular contraction, the left thigh 306 towards the first leg rest (as indicated by arrow 312), and their right leg 308 towards the second leg rest (as indicated by arrow 310), i.e. in opposite directions, perpendicular to the axis of the device. Since the user is holding the handles 304, 305, their legs 306, 308 do not move and are in isometric engagement with the device at the leg rests. As a result, since the user's legs 306, 308 don't move, the force of the muscular contractions of each side cause a pelvic rotation. By turning in opposite directions, both sides of the pelvis innominates can be urged back to a neutral position, aligning the sacroiliac joint, the posterior superior iliac spine, the anterior superior iliac spine, and pubic symphysis, reducing pressure on through the spine. Furthermore, the isometric contractions can strengthen the muscles involved over time, to help sustain alignment.

On one side the muscles contracted include the rectus femoris, psoas major, psoas minor, iliacus, and hip flexor muscle groups for anterior rotation. On the other side the user contracts the bicep femoris, semitendonosis, semimembranouses, and hip extensor muscle groups to urge the pelvis into posterior rotation. The device can be reversed, and then the legs can be urged in the opposite directions relative to the initial contractions to create rotation in the opposite direction. In practice, a user can use the device in a first orientation, contract the corresponding muscle groups on each side of their body, urging their legs in opposite directions in isometric engagement with the respective leg rests, for a selected period time, followed by a rest period, and then repeating the exercise several times, with rest in between each isometric engagement period. The device can then be flipped over to repeat the exercises to cause an opposite rotation. Alternatively, the device can be flipped between each isometric engagement period to alternate rotational directions of the pelvis.

Figure 4:
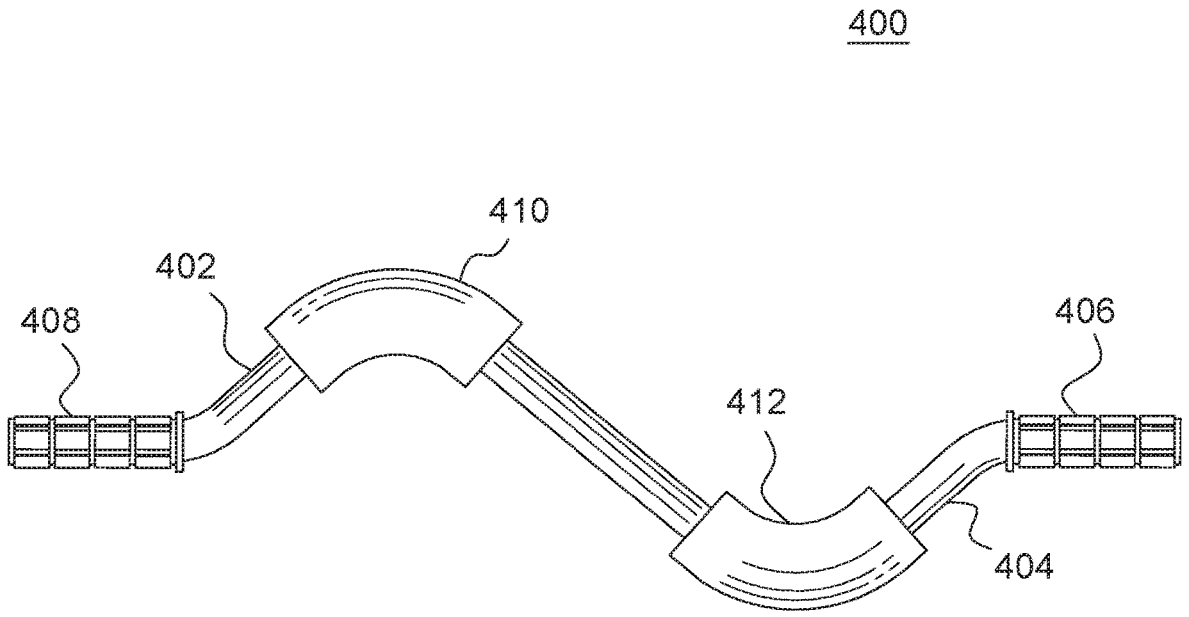
FIG. 4 is a top plan view of a physical therapy device for relieving lower back pain, in accordance with some embodiments.

FIG. 4 is a top plan view of a physical therapy device 400 for relieving lower back pain, in accordance with some embodiments. The device 400 of FIG. 4 is similar to that of device 100 of FIG. 1 in shape, but the body of the device is entirely tubular, including the leg rest portions 402, 404. Tubular foam pad members 410, 412 can be slid over the tubular body of the device to the respective apexes of the first and second leg rest portions 402, 404. The ends of the device 400 can then have handles or handgrips 406, 408 for the user to grip and hold while using the device 400, for example, as described with regard to FIG. 3.

Figure 5:
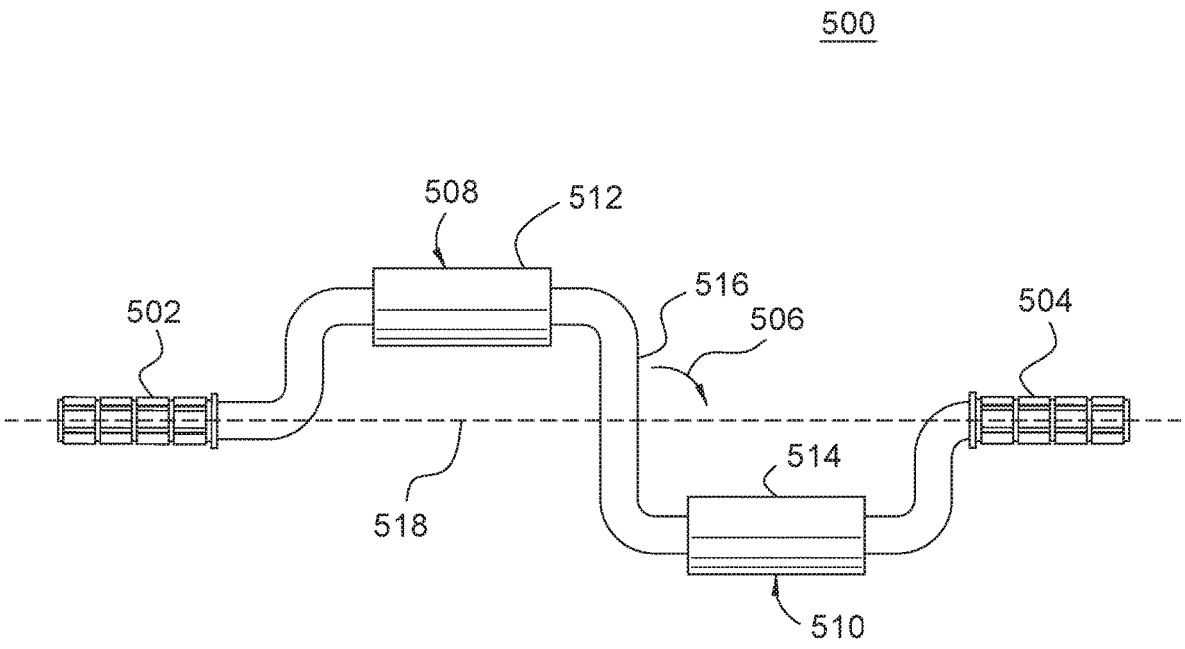
FIG. 5 is a top plan view of a physical therapy device for relieving lower back pain, in accordance with some embodiments.

FIG. 5 is a top plan view of a physical therapy device 500 for relieving lower back pain, in accordance with some embodiments. The device 500 includes handles 502, 504 at opposite ends of the device 500. Between the handles, the body of the device 500 forms first and second leg rests 508, 510 that include pads 512, 514, respectively. In embodiments represented by device 500, the leg rests 508, 510 are squared, rather than rounded/arcuate, and are joined by a middle portion 516 that traverses the axis 518 of the device 500 at a ninety degree angle 506. The span along, and displacement from, the axis of the leg rests 508, 510 can vary, but in general, as with devices 100, 400, the leg rests 508, 510 are configured such that the user's thighs are substantially parallel when the device 500 is used (e.g. as shown in FIG. 3).

Figure 6:
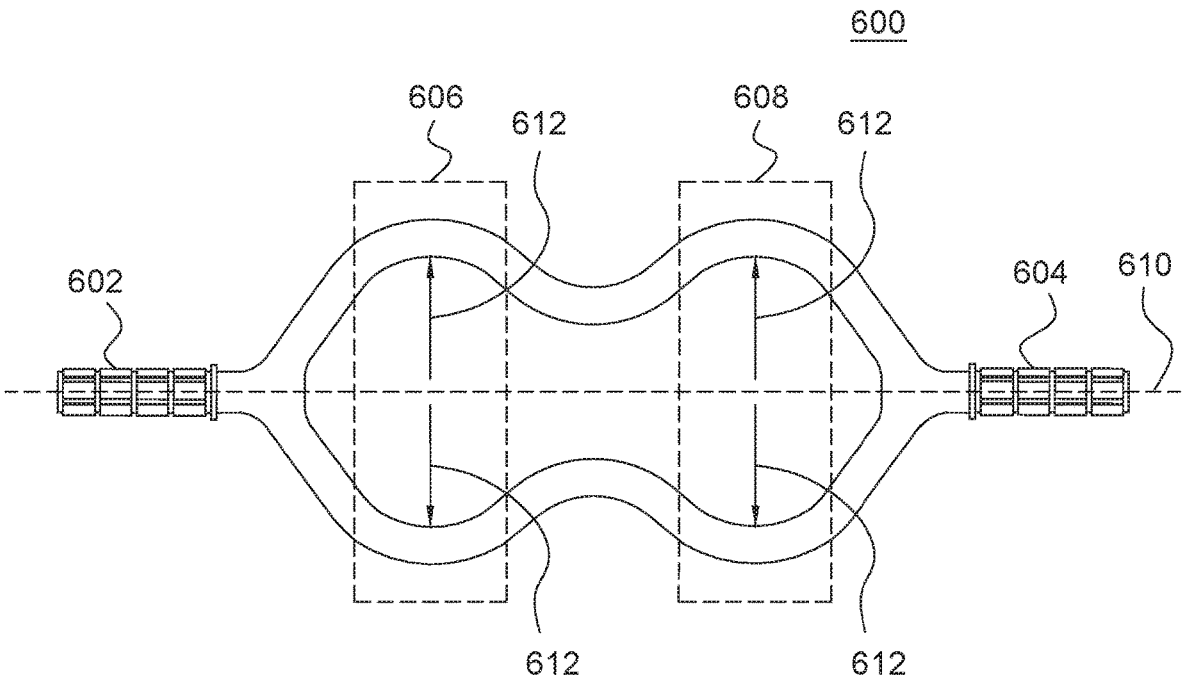
FIG. 6 is a top plan view of a physical therapy device for relieving lower back pain, in accordance with some embodiments.

FIG. 6 is a top plan view of a physical therapy device 600 for relieving lower back pain, in accordance with some embodiments. The device 600 represents embodiments that do not have a portion passing between the user's legs. Rather, the leg rests for each leg include portions in front of, and behind the user's legs. The device 600 has first and second handles 602, 604, respectively, at opposite ends of the device, which are formed in line with each other on an axis 610. A first leg rest 606 and a second leg rest 608 each include opposing portions formed on either side of the axis, and displaced away from the axis 610 by a distance 612. As shown, each leg rest portion 606, 608 include opposing sides configured to alternatively isometrically engage the front or back of a user's thigh while the other thigh is urged in the opposite direction (e.g. forward or backward, not side to side with respect to the user's body). The leg rest portions 606, 608 include arcuate portions as shown, but can also be arranged in substantially squared arrangements. Likewise, pads can be disposed on the leg rest portions as shown in FIGS. 1-5. Arrangements such as that represented by device 600 require that the user lift their legs to place them within the leg rest portions, rather than inverting or flipping a device configured as in FIGS. 1-5.

Figure 7:
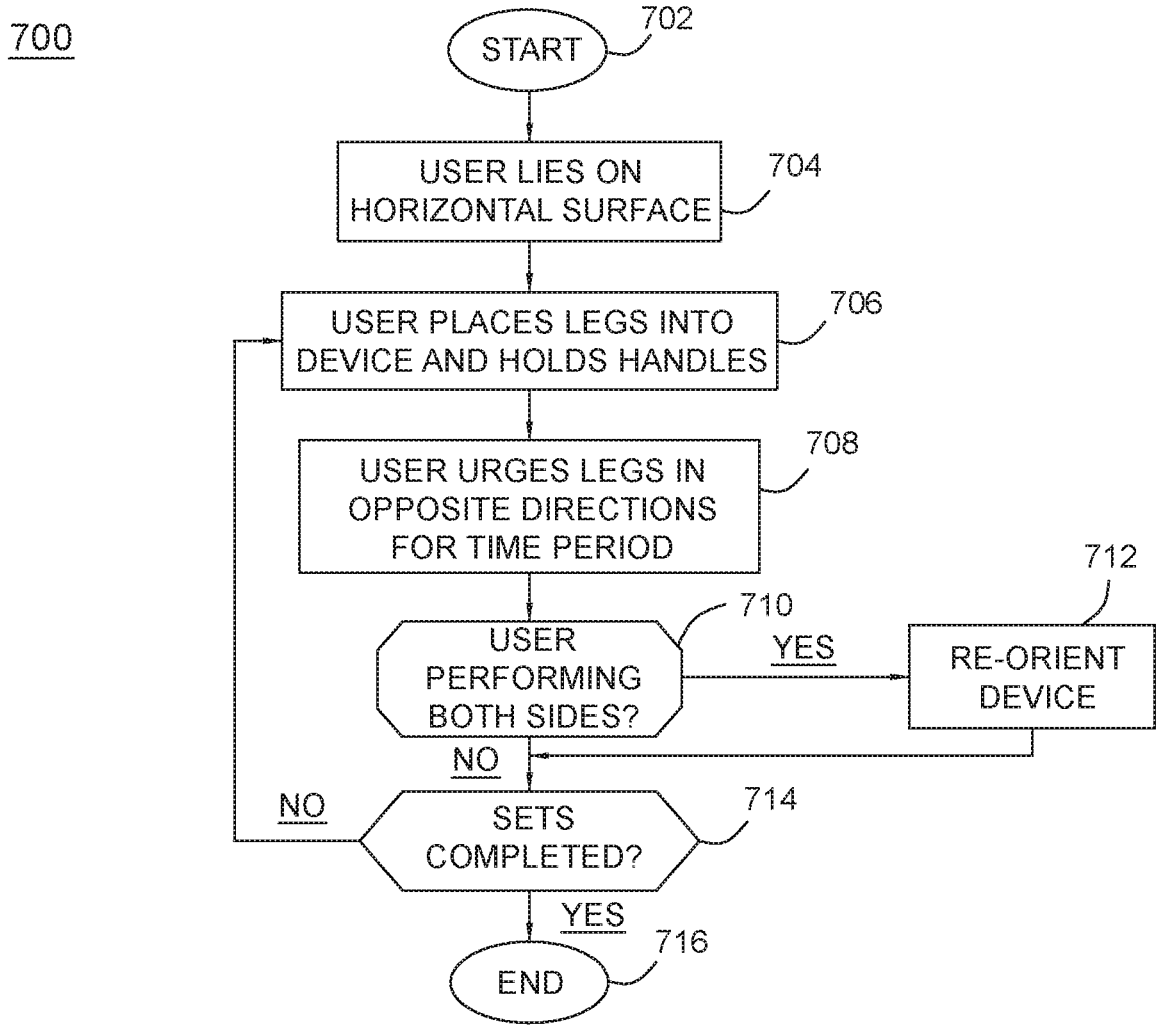
FIG. 7 is a flowchart diagram of a method for using a physical therapy device for relieving lower back pain, in accordance with some embodiments.

FIG. 7 is a flowchart diagram of a method 700 for using a physical therapy device for relieving lower back pain, in accordance with some embodiments. At the start 702 the user, who may be supervised by a physical therapist or other qualified professional, is ready to commence the exercises using the physical therapy device. At step 704 the user lies on their back on a substantially horizontal surface. In step 706 the user arranges the device so that the user's thighs, at about mid-thigh, are in contact with the respective leg rests of the device. At the same time, the user grasps the handles on each end of the device with their corresponding hands. In step 708 the user contracts their respective muscle groups to urge their legs in opposite directions (forward and backward) against the leg rests while holding onto the ends for a given time period. This represents an isometric exercise that urges rotation of the pelvis and serves to strengthen the respective muscle groups as well. In step 710, if the user is exercising both sides, meaning urging the pelvis to rotate in both directions, then in step 712 the device can be re-oriented and the exercise repeated by reversing the direction in which each leg is urged. In step 714 if there are a number of sets or repetitions being performed, then the method returns to step 708 and another set can be performed. If the user has completed the exercises, then the method 700 ends 716.

Figure 8:
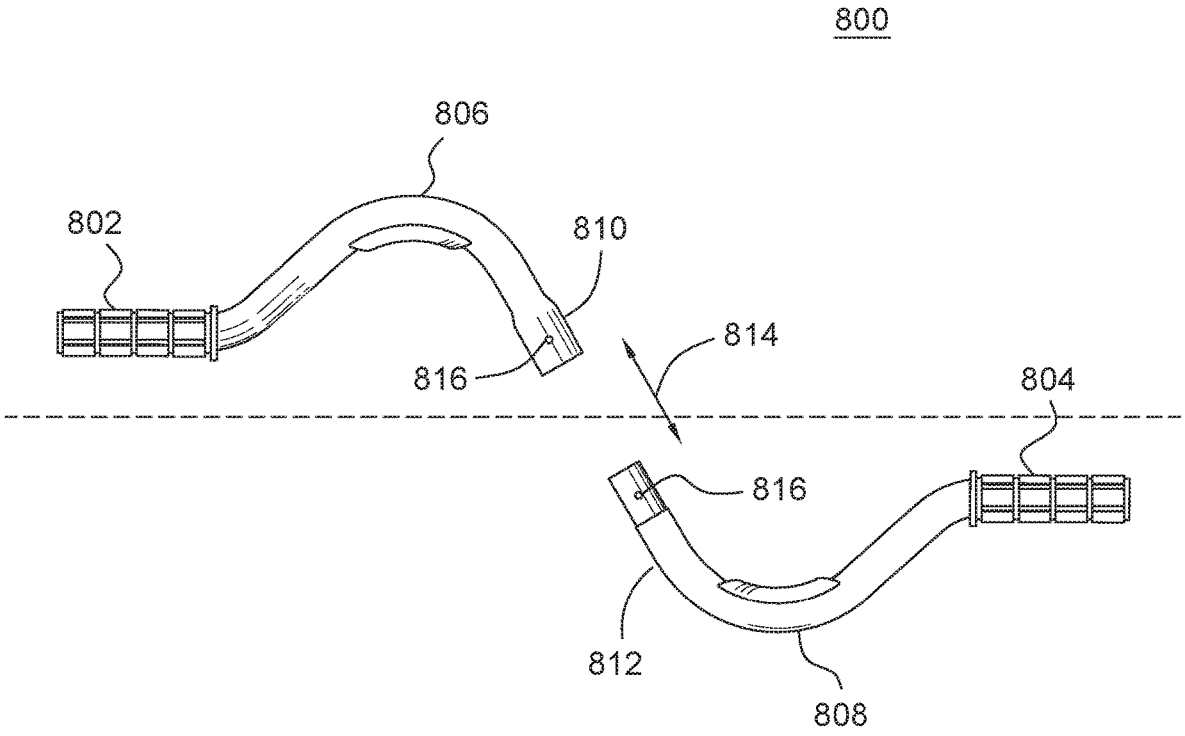
FIG. 8 shows a top plan view of a physical therapy device for relieving lower back pain that is assembled in halves.

FIG. 8 shows a top plan view of a physical therapy device 800 for relieving lower back pain that is assembled in halves. The device includes handles 802, 804 at opposite ends of the device, and leg rests 806, 808. Handle 802 and leg rest 806 are formed on a first half of the device 800, and handle 804 and leg rest 808 are formed on a second half. The first half has a connecting end 810 that mates with a corresponding connecting end 812 of the second half when the two halves are moved into engagement, as indicated by arrow 814. When joined together, the two halves form a substantially rigid device such that the halves do not move, relative to each other. In some embodiments a pin can be inserted through holes 816, 818 to hold the two halves together.

Figure 9:
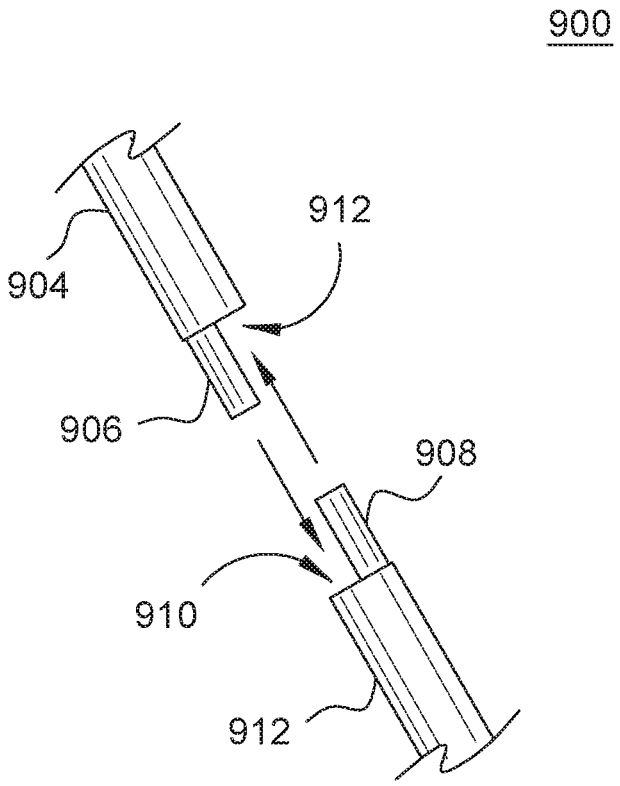
FIG. 9 show a the connecting ends of two halves of a physical therapy device, in accordance with some embodiments.
Figure 10:
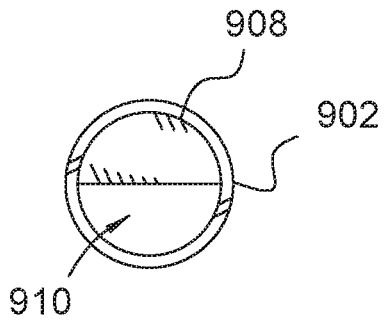
FIG. 10 shows and end view of the a connecting end of one of the halves of FIG. 9.

FIG. 9 show a the connecting ends 902, 904 of two halves of a physical therapy device, in accordance with some embodiments. FIG. 10 shows an end view of end 902. End 904 can have an engagement extension 906 that fits into a recess 910 in end 902. Likewise end 902 can have a corresponding extension 908 that fits into recess 912 in end 904. When the two ends are moved into engagement, the extensions 906, 908 hold the halves together against the inside of the recesses 910, 912 in a rigid manner. The halves can then be retained together by a pin that passes through both halves, or my sprung detents, and so on, as will be appreciated by those skilled in the art.

A physical therapy device has been disclosed that isometrically engages a user's legs at about the mid-thigh as the user holds opposite ends of the device and urges their legs in opposite directions. This muscle energy technique results in a rotational force being imparted to the user's pelvis, which can act to re-align the user's pelvis with regard to the lower spine, thereby alleviate pressure on the lower spine. The user can then use the device to create pelvic rotation in the opposite direction. By contracting opposing muscle groups associated with each leg isometrically, the user can also strengthen those muscle groups, as well as lengthen muscles that had become shortened due to the user compensating for, or reacting to, lower back pain, providing the user a neutrally positioned and stable pelvis over time. This is a substantial advantage over prior art devices which seek to stretch the back/spine longitudinally, rather than using a rotational force to bring the pelvis back into alignment.

What is claimed is:

1. A physical therapy device for relieving forms of lower back pain, comprising:

a longitudinal body having a first end and a second end opposite the first end and defining an axis between the first end and the second end, the longitudinal body further having a midpoint on the axis;

a first handle formed at the first end of the longitudinal body and extending along the axis and having a distal end and a proximal end, the distal end and proximal end of the first handle both on the axis defined by the longitudinal body, the distal end of the first handle being farther from the midpoint than the proximal end of the first handle;

a second handle formed at the second end of the longitudinal body and extending along the axis and having a distal end and a proximal end, the distal end and proximal end of the second handle both on the axis defined by the longitudinal body, the distal end of the second handle being farther from the midpoint than the proximal end of the second handle;

a first leg rest formed by a portion of the longitudinal body which deviates from the axis between the proximal end of the first handle and the midpoint of the longitudinal body; and a second leg rest formed by a portion of the longitudinal body which deviates from the axis between the proximal end of the second handle and the midpoint of the longitudinal body in a direction opposite that of the first leg rest with respect to the axis.

2. The physical therapy device of claim 1, further comprising a first pad disposed on the first leg rest and a second pad disposed on the second leg rest.

3. The physical therapy device of claim 1, wherein the first leg rest and second leg rest each comprise an apex having a radius facing the axis.

4. The physical therapy device of claim 3, wherein the apex of each of the first leg rest and second leg rest around their respective radiuses are wider, in a direction perpendicular to a plane defined by the longitudinal body, than portions of the longitudinal body on both sides of the apexes.

5. The physical therapy device of claim 3 wherein a distance between the apex of the first leg rest and the apex of the second leg rest, as measured along the axis, is between 10 and 13 inches.

6. The physical therapy device of claim 1, wherein the first leg rest and second leg rest are joined together by a transverse member that crosses the axis at angle between 45 degrees and 90 degrees with respect to the axis.

7. The physical therapy device of claim 1, wherein the first leg rest and second leg rest are joined by respective transverse portions that couple together at a midpoint of the physical therapy device, between the first leg rest and second leg rest.

8. The physical therapy device of claim 1, wherein the longitudinal body is tubular.

9. The physical therapy device of claim 1, wherein a displacement distance is defined between the axis and the first leg rest and between the axis and the second leg rest, wherein the displacement distance is between three and six inches.

10. A pelvic alignment tool having a body and having first and second ends which define an axis between the first and second ends, comprising:

a first handle formed at the first end of the body and extending along the axis and having a distal end and a proximal end, the distal end and proximal end of the first handle both on the axis defined between the first and second ends of the longitudinal body, the distal end of the first handle being farther from the midpoint than the proximal end of the first handle;

a second handle formed at the second end of the body and extending along the axis and having a distal end and a proximal end, the distal end and proximal end of the second handle both on the axis defined between the first and second ends of the longitudinal body, the distal end of the second handle being farther from the midpoint than the proximal end of the second handle;

a first leg rest formed as a deviation from the axis of the body between the proximal end of the first handle and a midpoint of the body of the pelvic alignment tool and configured to receive a first thigh of a user; and a second leg rest formed as a deviation from the axis of the body between the proximal end of the second handle and the midpoint of the body of the pelvic alignment tool in an opposite direction from the first leg rests with respect to the axis, and configured to receive a second thigh of a user;

wherein the first leg rest and the second leg rest are further configured to isometrically engage the first and second thighs when the user urges the first and second thighs in opposite directions perpendicular to the axis between the first and second ends while holding the first and second handles substantially stationary.

11. The pelvic alignment tool of claim 10, further comprising a first pad disposed on the first leg rest and a second pad disposed on the second leg rest.

12. The pelvic alignment tool of claim 10, wherein the first and second leg rests each comprise an apex having a radius facing the axis.

13. The pelvic alignment tool of claim 12, wherein the apex of each of the first and second leg rests around their respective radiuses are wider, in a direction perpendicular to a plane defined by the pelvic alignment tool, than portions of the pelvic alignment tool on either sides of the apexes.

14. The pelvic alignment tool of claim 12 wherein a distance between the apex of the first leg rest and the apex of the second leg rest, as measured along the axis, is between eight and fourteen inches.

15. The pelvic alignment tool of claim 10, wherein the first leg rest and second leg rest are joined together by a transverse member that crosses the axis at angle between 45 degrees and 90 degrees with respect to the axis.

16. The pelvic alignment tool of claim 10, wherein the first leg rest and second leg rest and joined by respective transverse portions that couple together at a midpoint of the pelvic alignment tool, between the first and second leg rests.

17. The pelvic alignment tool of claim 10, wherein a body of the pelvic alignment tool is tubular.

18. The pelvic alignment tool of claim 10, wherein a displacement distance is defined between the axis and the first leg rest and between the axis and the second leg rest, wherein the displacement distance is between three and six inches.

19. A device for isometrically exercising a user's hip extensors and hip flexors to adjust pelvic alignment, the device including a longitudinal body, the device comprising:

a first handle at a first end of the longitudinal body, the first handle having a distal end and a proximal end, the distal end of the first handle at a first end of the longitudinal body;

a second handle at a second end of the longitudinal body, the second handle having a distal end and a proximal end, the distal end of the second handle at a second end of the longitudinal body that is opposite the first end of the longitudinal body wherein an axis of the longitudinal body is defined between the first end of the longitudinal body and the second end of the longitudinal body, and wherein the distal end and the proximal end of the first handle are both on the axis of the longitudinal body, the distal end of the first handle being farther from the midpoint than the proximal end of the first handle, and the distal end and the proximal end of the second handle are both on the axis of the longitudinal body, the distal end of the second handle being farther from the midpoint than the proximal end of the second handle;

a first leg rest member formed in the longitudinal body as a portion of the longitudinal body that deviates from the axis of the longitudinal body between the proximal end of the first handle and a midpoint of the longitudinal body; and a second leg rest member formed in the longitudinal body as a portion of the longitudinal body that deviates from the axis of the longitudinal body between the proximal end of the second handle and the midpoint of the longitudinal body, and wherein the portion of the longitudinal body forming the second leg rest deviates from the axis in a direction opposite the first leg rest with respect to the axis of the longitudinal body.

20. The device of claim 19, further comprising a first pad disposed on the first leg rest member and a second pad disposed on the second leg rest member.

* * * * *